US009090388B2

(12) United States Patent
Kruelle et al.

(10) Patent No.: US 9,090,388 B2
(45) Date of Patent: Jul. 28, 2015

(54) VOID BOARD AND PACKAGING USING A VOID BOARD

(75) Inventors: John M. Kruelle, Glendale, AZ (US); Michael J. Kaufman, Morton Grove, IL (US)

(73) Assignee: Signode Industrial Group, LLC, Glenview, IL (US)

( * ) Notice: Subject to any disclaimer, the term of this patent is extended or adjusted under 35 U.S.C. 154(b) by 322 days.

(21) Appl. No.: 13/470,443

(22) Filed: May 14, 2012

(65) Prior Publication Data

US 2012/0292221 A1 Nov. 22, 2012

Related U.S. Application Data

(60) Provisional application No. 61/488,018, filed on May 19, 2011.

(51) Int. Cl.
*B65D 85/46* (2006.01)
*B65D 71/00* (2006.01)

(52) U.S. Cl.
CPC .. *B65D 71/0088* (2013.01); *B65D 2571/00043* (2013.01); *B65D 2571/00117* (2013.01); *Y10T 428/2457* (2015.01); *Y10T 428/24479* (2015.01)

(58) Field of Classification Search
CPC ..... B65D 71/0088; B65D 71/0092; B65D 71/0096; B65D 2571/00043; B65D 2571/00049
USPC ..... 206/386; 211/59.4; 428/43, 120, 166, 428/167, 188, 903.3
See application file for complete search history.

(56) References Cited

U.S. PATENT DOCUMENTS 2,869,721 A * 1/1959 Baumer ..... 206/322
2,962,163 A * 11/1960 Else ..... 206/322
3,189,175 A * 6/1965 Cruckshank ..... 206/322
4,245,013 A 1/1981 Clegg et al.
4,816,316 A 3/1989 Robbins
6,827,179 B2 12/2004 Drake et al.
6,989,184 B2 1/2006 Duke et al.
7,838,095 B2 11/2010 Varma et al.
7,968,172 B2 * 6/2011 Ausen et al. ..... 428/174
2008/0311334 A1 12/2008 Kruelle et al.
2008/0311335 A1 * 12/2008 Kruelle et al. ..... 428/43

FOREIGN PATENT DOCUMENTS

CA 2492233 A1 9/2005
GB 2427185 A 12/2006
WO 2007055662 A1 5/2007

OTHER PUBLICATIONS

International Preliminary Report on Patentability for PCT/US2008/064499 dated May 22, 2008.

* cited by examiner

*Primary Examiner* — Anthony Stashick
*Assistant Examiner* — Ernesto Grano
(74) *Attorney, Agent, or Firm* — Levenfeld Pearlstein, LLC

(57) ABSTRACT

A void board is configured for placement between adjacent horizontal layers of bricks to maintain an opening in a lower of the layers. The void board includes a relatively thin base element having first and second opposing sides and a plurality of ribs extending along a length of the base element. The ribs extend from the first and second sides, generally transverse to the base element. The ribs are positioned such that the ribs that extend from the first side of the base element are offset from the ribs extending from the second side of the base element. The base element has a longitudinally extending central region, between a closest pair of ribs, that is devoid of ribs. A bundled load of objects have the void board positioned therein and a method of bundling a load of objects are also disclosed.

13 Claims, 2 Drawing Sheets

VOID BOARD AND PACKAGING USING A VOID BOARD

CROSS-REFERENCE TO RELATED APPLICATION DATA

This application claims the benefit of priority of Provisional U.S. patent application Ser. No. 61/488,018, filed May 19, 2011, the entire disclosure of which is incorporated herein by reference.

BACKGROUND

Bricks and other masonry materials are typically bundled as a plurality of stacked individual units (i.e., individual bricks) formed into a 3-dimensional bundle. The bundle includes one or More package straps, corner protectors, and a void board that is placed between two horizontal layers of bricks. Generally, the void board is placed above a layer of bricks that has bricks omitted, e.g., forming openings in the bundle. Additional layers of bricks are placed on top of the board. The openings, which are typically centrally disposed, are configured to allow the tines of a forklift or similar device to pass into the bundle. In moving the package of bricks, the forklift exerts a force on the underside of the board to lift the entire package. Typically, the openings are formed extending through the entire depth of the bundle.

One known void board is formed as a veneer. These veneer void boards are often of poor quality and have a tendency to warp and degrade after prolonged exposure to the elements. Warping results in uneven surfaces upon which layers of bricks are stacked, which in turn can result in package instability and/or the inability to insert the forklift tines.

Other void boards use solid or ribbed plastic sheets. Such void boards are disclosed in Duke et al., U.S. Pat. No. 6,989,184, Varma, et al., U.S. Pat. No. 7,838,095, and Kruelle et al., Published U.S. Patent applications publication Nos. 2008/0311334 and 2008/0311335, all of which are commonly assigned with the present application and incorporated herein by reference. While the polymeric void boards have been found to function well at a given thickness, they require a higher material weight (and thus, cost) than desired for such a consumable item. When a thinner sheet is used (and thus, less material), it has been found that the boards may not have the desired stiffness. To increase stiffness, a board having a wide, ski-like element formed on one or both sides of the board has been used. While this functions well for some applications, it also adds material weight and cost to the board.

Moreover, there has been an industry shift to the use of textured bricks. These bricks, unlike conventional bricks, may not have flat sides or faces. Rather, the faces of the bricks may be irregularly shaped or non-planar. As such, when a ski-containing sheet-like board is used, the bricks may tend to lean or skew to one side, because the ski creates a fulcrum on which the bricks rest. This results in the brick bundle not being properly strapped and can cause package (bundle) instability and/or failure.

Other polymeric or plastic sheets have been used that include embossings or shapes formed in the sheets, transverse to the plane of the sheet. It has been observed that the embossings can collapse under the weigh of the bricks, especially when the bundle is subject to vibration, as during transport, and consequently bundle failure can occur.

Accordingly, there is a need for a void board that is of consistent quality, reliability, and strength to allow stable stacking of bricks for bundle forming, without crushing the board. Desirably, such a void board does not collapse after exposure to the elements and/or vibration, and provides a planar, consistent support, even when used with irregularly surfaced bricks.

More desirably, such a void board is used as a component in a brick package or bundle in which corner edge protectors and straps are used to complete the package to, for example, facilitate storage, handling, shipping and the like.

SUMMARY

A polymeric void board is configured for placement between adjacent horizontal layers of bricks to maintain an opening in a lower of the brick layers. The board includes a relatively thin base element having first and second opposing sides. A plurality of ribs extends along a length of the base element. The ribs extend from both the first and second sides, generally transverse to the base element.

In an embodiment, the ribs are positioned such that the ribs extending from the first side of the base are offset from the ribs extending from the second side of the base element. The base element has a longitudinally extending central region, between a closest pair of ribs, that is devoid of ribs.

In this embodiment, the ribs extend from the base element at a base portion. The base portion has a width that is less than a width of an end of the ribs. In such a configuration, the ribs have a truncated pyramidical profile that defines a truncated portion that is contiguous with the base element. The ribs can be formed in mirror image relation to one another relative to a longitudinal centerline of the base element. A recess can be formed in the base element, on the side opposite of each rib.

The void board is preferably formed from a thermoplastic or thermoplastic-blend material. The material can be a filled polymer.

In another embodiment void board is formed as a relatively thin base element having first and second opposing sides and a plurality of ribs extending along a length of the base element. The ribs extend from the first and second sides, generally transverse to the base element, and are positioned such that the ribs extending from the first side of the base element are aligned with the ribs extending from the second side of the base element. Each rib, when viewed in cross-section, has a semi-circular profile.

A bundled load of objects is formed with the void board. In such a bundle, an array of objects are arranged in multiple horizontal layers. Each horizontal layer is formed of multiple objects. At least one opening is defined in at least one horizontal layer by an absence of at least one object.

The array defines four sides, a top and a bottom. The four sides, top and bottom define four vertical edges, four top horizontal edge and four bottom horizontal edges.

The polymeric void board is positioned between the horizontal layer of objects having the opening therein and an adjacent upper horizontal layer of objects. At least one corner edge protector is positioned on one of the top or bottom horizontal edges and strap is positioned around the array and the corner edge protector to secure the corner edge protector against the edge.

Corner edge protectors can be positioned at opposing top horizontal edges and multiple straps can be positioned around the array to form the bundle of objects.

A method of bundling a load of objects includes the steps of providing an array of objects arranged in multiple horizontal layers with each horizontal layer formed of multiple objects. The bundle includes at least one opening in at least one horizontal layer that is defined by an absence of at least one object. The array defines four sides, a top and a bottom. The four sides, top and bottom define four vertical edges, four top horizontal edges and four bottom horizontal edges, A void board is positioned between horizontal layers of objects, above the layer having the opening therein. An edge protector is positioned on at least one top horizontal edge and a strap is positioned around the load of objects and the edge protector to secure the edge protector to the load and to bundle the load.

These and other features and advantages of the present invention will be readily apparent from the following detailed description, in conjunction with the claims.

DETAILED DESCRIPTION

Figure 1:
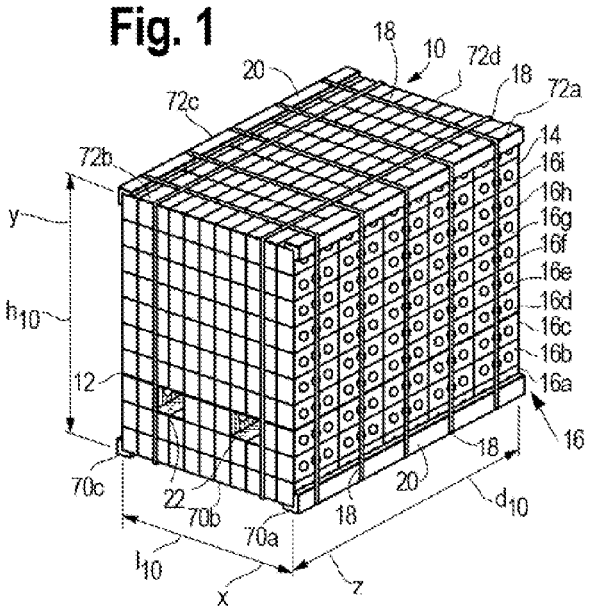
FIG. 1 is a perspective view of a bundle of bricks having a void board disposed between horizontal layers of bricks, the bundle being shown with edge/corner protectors and strapping material around the bundle to secure the bundle.
Figure 2:
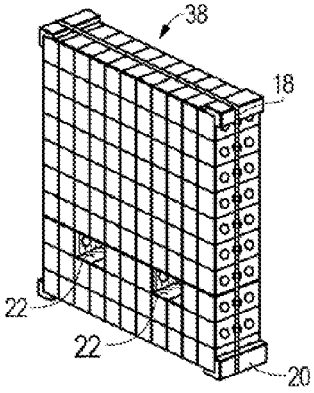
FIG. 2 is a perspective view of one vertical layer of bricks separated from the bundle of FIG. 1.

While the present device is susceptible of embodiments in various forms, there is shown in the drawings and will hereinafter be described exemplary and non-limiting embodiments, with the understanding that the present disclosure is to be considered an exemplification of the device and is not intended to be limited to the specific embodiments illustrated.

With reference now to the figures and in particular to FIG. 1, a bundle 10 of bricks 14 is shown with a void board 12. The bundle 10 is a 3-dimensional stack of individual bricks 14 that form a matrix with a plurality of horizontal layers, e.g., 16*a-j*. The bundle 10 thus defines a length $l_{10}$, a height $h_{10}$ and a width $w_{10}$, which are represented by the x, y and z directional axes as shown.

The bundle 10 is maintained in the 3-dimensional configuration by straps 18 that are positioned about the bundle 10. In a typical bundle 10, vertical straps (in the y-direction) are positioned around the bundle 10 extending in both the x and z-directions. Horizontal straps (not shown) can be used. Corner edge protectors 20 are disposed along the corners of the bundle 10 between the bricks 14 and strap 18 to protect the bricks 14 from damage due to rubbing and accidental bumping. The corner protectors 20 also preclude strap 18 failure due to, for example, abrasion.

In order to readily transport the bundle 10, openings 22 are formed in the bundle 10 by removing or eliminating bricks 14 in a predetermined area of the matrix. The openings 22 are configured to, for example, permit the insertion of the t of a forklift. In this manner, the tines can be inserted into the openings 22 and the bundle 10 raised and transported as desired.

To maintain the layer 16*d* of 14 bricks above the opening 22, the void board 12 is placed between the horizontal layers 16*c* and 16*d* of bricks 14, that is, above the layer 16*c* in which the openings 22 are formed.

An embodiment of the void board 12 is illustrated in FIGS. 3-6. The board 12 is fabricated as an extruded member and includes a planar base 28 element. A plurality of stand-offs or ribs 30 extend longitudinally along the length $l_{12}$ of the element 28 from first and second sides 32, 38 respectively. In an embodiment, the ribs 30 are parallel and are generally equal in height $h_{30}$. In the illustrated embodiment, the ribs 30 have a truncated triangular cross-section with the truncated or upper portion 34 of the triangle formed integral (e.g., contiguous) with the base element 28. A recess 36 can be formed in the base element 28, opposite each rib 30. It has been found that the recess, if used, may add strength to the board 12. It will be appreciated that although truncated triangular shaped ribs 30 are shown, these are exemplary and that the ribs 30 can take many other shapes, such as cruciform, semi-circular and like profiles.

In an embodiment of the board 12, the ribs 30 are formed extending from both sides 32, 38 of the base element. The ribs 30 can be formed in a staggered configuration so that the ribs 30*a* extending from one side 32 of the base element 28 do not oppose the ribs 30*b* extending from the other side 38 of the base element 38. That is, the ribs 30*a* extending from one side 32 of the base element 28 are between ribs 30*b* extending from the opposite side 38 of the base element 28. It has been found that this staggered arrangement of the ribs 30 prevents high and/or low spots as the bricks 14 lie on the board 12, that could otherwise tend to allow the bundle 10 to skew. The staggered arrangement can also permit the board to dissipate heat and thus cool faster during manufacture.

In the embodiment illustrated in FIG. 3-6, the ribs 30 are formed on each side 32, 38 of the base element 28, equally spaced from a centerline or longitudinal axis $A_{12}$ of the base element 28. That is, on side 32, the ribs 30*a* on each side of the center line (for example ribs 30*a*') are equally spaced from the centerline $A_{12}$ and on the other side 38 of the base element 28, (for example, the ribs 30*b*') are also equally spaced from the centerline $A_{12}$.

Figure 3:
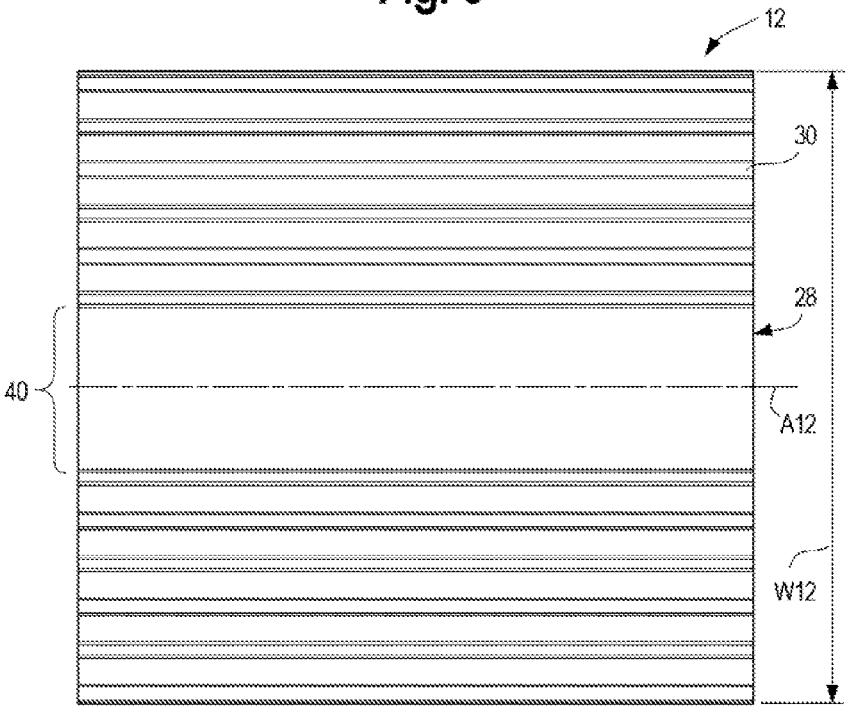
FIG. 3 is a top view of an embodiment of the void board.
Figure 4:
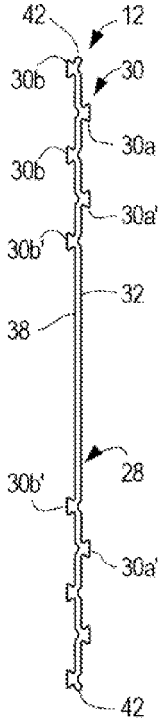
FIG. 4 is a cross-sectional view taken along line 4-4 of FIG. 3.
Figure 5:
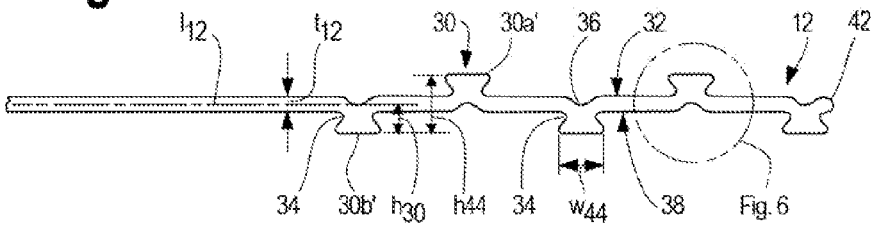
FIG. 5 is an enlarged view of one side of the void board FIG. 3.
Figure 6:
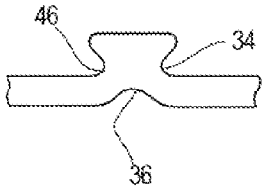
FIG. 6 is an enlarged view of the circled area of FIG. 5.

As seen in FIG. 3, the center region 40 of the board 12, generally about the centerline $A_{12}$, is relatively flat. It will be appreciated that this flat region 40 provides an area for automated equipment to pick and move the board 12. Typically, picking is carried out using vacuum-type devices and, as such, a flat center region 40 permits the application of vacuum with a high degree of confidence.

A present board 12 can be manufactured in a variety of lengths, particularly, if the board is manufactured using extrusion methods. An exemplary board 12 has a width $w_{12}$ of about 5.0 to 5.5 inches and a thickness $t_{12}$ of about 0.05 inches. The board 12 can include ten ribs, five on each side of the centerline $A_{12}$. In this arrangement, four ribs 30*a* are formed on one side 32 of the board 12 and six ribs 30*b* on the opposite side 38 of the board 12. The ribs 30 can be formed with the inboard most ribs 30*b*' formed about 2.25 inches spaced from one another (or about 1.125 inches from the centerline), and with the second set of ribs 30*a*' (on the opposite side 32 of the board 12) spaced about 3.0 inches apart (or about 1.5 inches from the centerline). The remaining ribs 30*a*, 30*b* can be equally spaced outboard of the first and second ribs 30*b*' and 30*a*' such that the spacing between ribs 30 is about equal to the edges 42 of the board 12. The last or outboard most ribs are formed at or near the outer edges 42 of the board 12.

The ribs 30 can extend transverse from the base element 28, relative to a center $C_{12}$ of the board 12 to a height $h_{30}$ of about 0.0935 inches (such that a rib end 44 to rib end 44 dimension or height $h_{44}$ is about 0.187 inches) and can extend from the surface 32 or 38 of the element 28 about 0.069 inches. The ribs 30, at the ends 44 can have a width $w_{44}$ of about 0.115 inches. A juncture (as indicated at 46) of the ribs 30 and the base element 28 can be rounded to better distribute stresses transferred from the ribs 30 to the base element 28.

Figure 7:
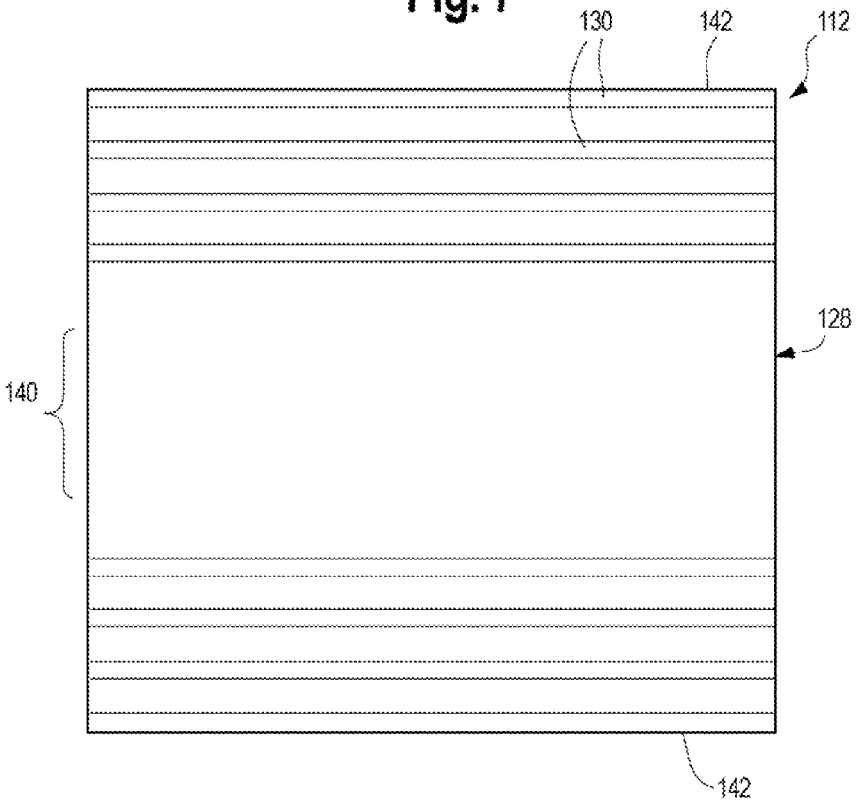
FIG. 7 is a top view on another embodiment of the void board.
Figure 8:
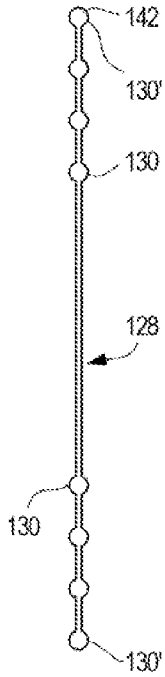
FIG. 8 is a cross-sectional view taken along line 8-8 of FIG. 7

An alternate embodiment of the board 112 is illustrated in FIGS. 7 and 8. In this embodiment, the ribs 130 extend from the base element 128 aligned with one another (see FIG. 8). The illustrated ribs 130 are formed having a semi-circular profile. The central region 140 of the base element 128 is without ribs to permit automatic (vacuum-assisted) transport of the boards 112. The ribs 130 can be equally spaced from one another, with the outer-most ribs 130' at or near the edge 142 of the board 112.

The materials from which the board 12, 112 is formed can vary. Exemplary materials include high density polyethylene (HDPE), polyvinylchloride (PVC), polyethylene terephthalate (PET), acrylonitrile butadiene styrene (ABS), polystyrene (PS), combinations of these and other polymers, and the like. Other suitable materials will be recognized by those skilled in the art. The materials can include, as desired, fillers, stabilizers, colorants and the like to achieve certain desired physical, chemical and processing (e.g., manufacturing) characteristics.

It is anticipated that the board 12, 112 will be formed by an extrusion process, however, other methods for manufacture of the board 12, 112 are contemplated.

In an exemplary bundling operation, full courses of bricks 14 are laid (e.g., layer 16*a*) until the course 16*c* that includes the forklift openings 22. Edge protectors 20 can be positioned at about the lower edges 70 of the first course 16*a* of bricks 14. The edge protectors 20 can be positioned at all four edges 70*a-d*, or at two, opposing edges 70*a*, 70*c* as desired. It is anticipated that edge protectors 20 will be used wherever strap 18 is positioned around the bundle 10 to prevent damage to the bricks 14, to prevent strap 18 failure, for example due to abrasion, and to better stabilize the bundle 10.

A partial course 16*c* of bricks 14 is then positioned outboard and between the positions that the forklift openings 22 will occupy. One or more void boards 12 are then positioned over the partial course 16*c* of bricks 14 that define the openings 22, and a full course 16*d* of bricks 14 is then positioned over the partial course 16*c* of bricks 14 and the void board 12 until a desired height (e.g., to 16*j*) of the bundle 10 is achieved. Edge 20 protectors can then be positioned along the top edges, for example at edges 72*a* and 72*c* to correspond to the location and position of the edge protectors 70*a* and 70*c* on the first course 16*a* of bricks 14, and strap material 18 is used to secure the bundle 10. A top sheet (not shown) may be provided on the bundle 10, between the bricks 14 and the strap 18 material, to provide additional protection for the bricks 14.

In the disclosure, the use of the disjunctive is intended to include the conjunctive. The use of the definite article or indefinite article is not intended to indicate cardinality. In particular, a reference to "the" object or "a" or "an" object is intended to denote also one of a possible plurality of such objects.

All patents referred to herein, are hereby incorporated herein by reference, whether or not specifically done so within the text of this disclosure.

From the foregoing it will be observed that numerous modification and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A polymeric void board for placement between adjacent horizontal layers of bricks to maintain an opening in a lower of the layers, the void board comprising:

a relatively thin base element having first and second opposing side surfaces and a longitudinally extending central region formed on each side of the base element; and a plurality of ribs extending along a length of the base element, the ribs extending from the first and second side surfaces, and extending outwardly generally transverse to, and away from, the base element, the ribs positioned such that the ribs extending from the first side surface of the base element are offset from the ribs extending from the second side surface of the base element, wherein each central region is devoid of ribs and is positioned between a pair of inboard most ribs on respective sides of the base element, wherein the pair of inboard most ribs on the first side surface of the base element are spaced apart by and bound the central region on the first side surface, the central region on the first side surface having a first central distance extending between the pair of inboard most ribs on the first side surface, and remaining ribs on the first side surface of the base element are spaced apart from a nearest adjacent rib on the first side surface by a first distance less than the first central distance, and wherein the pair of inboard most ribs on the second side surface of the base element are spaced apart by and bound the central region on the second side surface, the central region on the second side surface having a second central distance extending between the pair of inboard most ribs on the second side surface, and remaining ribs on the second side surface are spaced apart from a nearest adjacent rib on the second side surface by a second distance less than the second central distance.

2. The polymeric void board of claim 1 wherein the ribs extend from the base element at a base portion, the base portion having a width that is less than a width of an end of the ribs.

3. The polymeric void board of claim 2 wherein the ribs have a truncated pyramidical profile defining a truncated portion, wherein the truncated portion is contiguous with the base element.

4. The polymeric void board of claim 1 wherein the ribs are formed in mirror image relation to one another relative to a longitudinal centerline of the base element.

5. The polymeric void board of claim 1 wherein the void board is formed from a thermoplastic material.

6. The polymeric void board in accordance with claim 1 wherein the void board is formed from a thermoplastic-blend material.

7. The polymeric void board in accordance with claim 1 wherein the void board is formed from a filled polymer.

8. The polymeric void board in accordance with claim 1 wherein the ribs are parallel to one another.

9. The polymeric void board in accordance with claim 1 wherein the base element is planar.

10. A polymeric void board for placement between adjacent horizontal layers of bricks to maintain an opening in a lower of the layers, the void board comprising:

a relatively thin base element having first and second opposing sides and a longitudinally extending central region; and a plurality of ribs extending along a length of the base element, the ribs extending from the first and second sides, and extending outwardly generally transverse to, and away from, the base element, the ribs positioned such that the ribs extending from the first side of the base element are offset from the ribs extending from the second side of the base element, wherein the central region is devoid of ribs and is positioned between a pair of inboard most ribs on each side of the base element, wherein the inboard most ribs on the first side of the base element are spaced apart by a first central distance corresponding to the central region on the first side, and remaining ribs on the first side of the base element are spaced apart from a nearest adjacent rib on the first side by a first distance less than the first central distance, and wherein the inboard most ribs on the second side of the base element are spaced apart by a second central distance corresponding to the central region on the second side, and remaining ribs on the second side are spaced apart from a nearest adjacent rib on the second side by a second distance less than the second central distance, and wherein the base element, on the side opposite of each rib, includes a recess.

11. A bundled load of objects, comprising:

an array of objects arranged in multiple horizontal layers, each horizontal layer formed of multiple objects, the bundle including at least one opening in at least one horizontal layer defined by an absence of at least one object, the array defining four sides a top and a bottom, the four sides, top and bottom defining four vertical edges, four top horizontal edge and four bottom horizontal edges;

a polymeric void board positioned between the horizontal layer of objects having the opening therein and an adjacent upper horizontal layer of objects, the polymeric void board having a base element having first and second opposing side surfaces, and a plurality of ribs extending along a length of the base element, the ribs extending from the first and second side surfaces, generally transverse to the base element, the ribs positioned such that the ribs extending from the first side surface of the base element are offset from the ribs extending from the second side surface of the base element, the base element having a longitudinally extending central region between and bound by an inboard most pair of ribs on each side surface, each central region being devoid of ribs, the inboard most pair of ribs on each side surface spaced apart by a distance that is greater than a distance between each remaining rib and a nearest adjacent ribs on the same side surface;

at least one corner edge protector on one of the top or bottom horizontal edges; and a strap positioned around the array and the corner edge protector to secure the corner edge protector against the edge.

12. The bundled load of objects of claim 11 including corner edge protectors positioned at opposing top horizontal edges.

13. The bundled load of objects of claim 12 including multiple straps positioned around the array.

* * * * *